United States Patent [19]

Nishimura et al.

[11] Patent Number: 4,522,179

[45] Date of Patent: Jun. 11, 1985

[54] ENGINE SPEED DETECTING SYSTEM FOR MULTIPLE-DISPLACEMENT ENGINE

[75] Inventors: Hirofumi Nishimura; Hiroyuki Oda; Tadashi Kaneko; Akira Takai; Nobuo Takeuchi, all of Hiroshima, Japan

[73] Assignee: Mazda Motor Corporation, Hiroshima, Japan

[21] Appl. No.: 641,384

[22] Filed: Aug. 16, 1984

[30] Foreign Application Priority Data

Aug. 23, 1983 [JP] Japan ..... 58-152387

[51] Int. Cl.[3] ..... F02D 17/00

[52] U.S. Cl. ..... 123/481; 123/198 F; 123/494

[58] Field of Search ..... 123/198 F, 481, 494

[56] References Cited

U.S. PATENT DOCUMENTS

| | | | |
|---|---|---|---|
| 4,040,395 | 8/1977 | Demetrescu | 123/198 F |
| 4,172,434 | 10/1979 | Coles | 123/198 F |
| 4,354,471 | 10/1982 | Sugasawa | 123/481 |
| 4,469,071 | 9/1984 | Bassi | 123/481 |

*Primary Examiner*—Ronald B. Cox

*Attorney, Agent, or Firm*—Murray, Whisenhunt & Ferguson

[57] ABSTRACT

A multiple-displacement engine is provided with a cylinder number control means and a cylinder-reduction determination means in order to switch the operating state of the engine from the full-displacement operation to the part displacement operation or from the latter to the former according to the operating condition of the engine. A period calculating means receives signals generated from a crank angle detecting means every predetermined crank angle and calculates the time interval corresponding to the predetermined crank angle. An engine speed calculating means calculates the engine rpm on the basis of the calculated time interval or period. A crank angle determination means which receives the output from the cylinder-reduction determination means and sets the predetermined crank angle to be submitted to the period calculating means to include a crank angle corresponding to the power stroke of a working cylinder in the part-displacement state of the engine.

7 Claims, 10 Drawing Figures

ENGINE SPEED DETECTING SYSTEM FOR MULTIPLE-DISPLACEMENT ENGINE

BACKGROUND OF THE INVENTION

1. Field of the Invention

This invention relates to an engine speed detecting system for a multiple-displacement engine in which operating state of the engine can be changed between a full-displacement state in which all the cylinders output power and a part-displacement state in which a part of the cylinders are cut out or are made inoperative according to the operating condition of the engine.

2. Description of the Prior Art

In order to improve the fuel consumption rate, there has been proposed a multiple-displacement engine in which operating state of the engine can be changed between the full-displacement operation and the part-displacement operation according to the operating condition of the engine. See Japanese Unexamined Patent Publication No. 57(1982)-338. For example, when the engine operates under heavy load, e.g., when the vehicle starts or runs at a high speed, fuel is supplied to all the cylinders so that all the cylinders contribute to power output, while when the engine operates under relatively light load, e.g., when the vehicle cruises at a steady speed, fuel supply to a part of the cylinders is cut off to make inoperative the cylinders and to improve the volumetric efficiency of the remaining cylinders, thereby providing saving in fuel.

Such multiple-displacement engine is provided with a cylinder number control means for cutting fuel supply to a part of the cylinders to change the operating state of the engine to the part-displacement operation, and a cylinder reduction determination means which determines whether or not the operating state of the engine is to be changed to the part-displacement operation according to the operating conditions of the engine such as engine speed, throttle position, intake manifold vacuum and coolant temperature, and delivers the determination to the cylinder number control means.

Engine speed or engine rpm is often detected in order to control the engine, for example to control the idling speed, and to control the amount of fuel to be injected. The engine speed can be determined on the basis of the time required for the crankshaft to rotate by a predetermined angle or one period.

However, when the engine speed detection is simply applied to the multiple-displacement engine, the engine speed cannot be precisely detected in the part-displacement operation of the engine. That is, when the engine operates in the full-displacement state, the time required for the crankshaft to rotate by a predetermined crank angle hardly fluctuates for a given engine speed. However, when the engine operates in the part-displacement state the predetermined crank angle sometimes includes a power stroke and sometimes does not include a power stroke. Accordingly, the time required for the crankshaft to rotate by the predetermined angle fluctuates and engine speed detection becomes inexact.

SUMMARY OF THE INVENTION

In view of the foregoing observations and description, the primary object of the present invention is to provide an engine speed detecting system for a multiple-displacement engine which can precisely detect the engine speed even when the engine runs in the part-displacement state.

In accordance with the present invention, said predetermined angle for determining the engine speed is selected in the part-displacement state of the engine to include a crank angle corresponding to the power stroke of a working cylinder in which the engine intends to rotate most positively.

During the power stroke, the crankshaft rotates positively unlike during other strokes in which it rotates under the force of inertia, and accordingly the period of the power stroke is most preferable for detecting the precise engine speed. Thus, in accordance with the present invention, the engine speed can be detected precisely even in the part-displacement state of the engine.

DESCRIPTION OF THE PREFERRED EMBODIMENT

Figure 1:
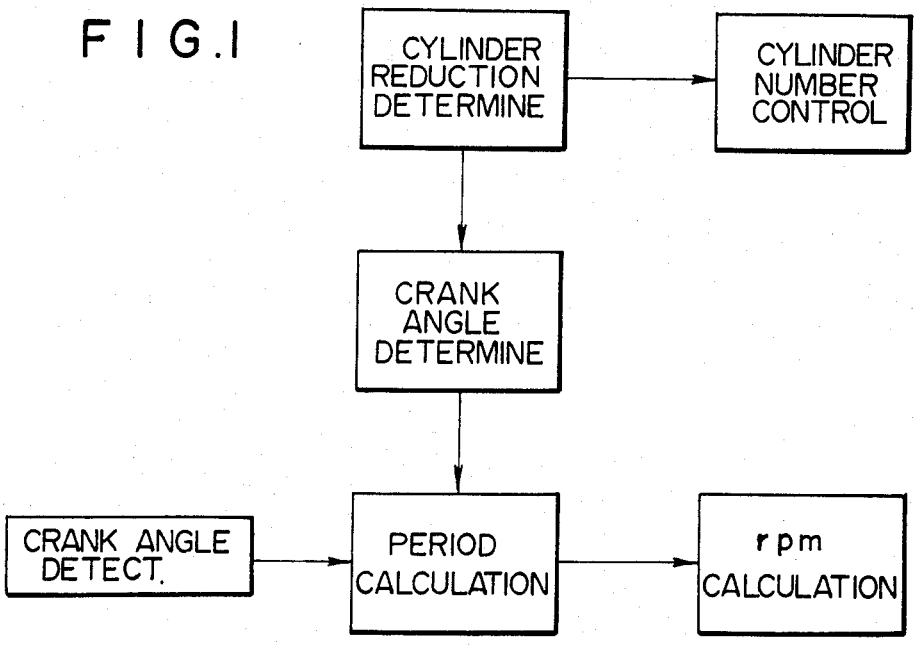
FIG. 1 is a schematic view illustrating the overall operation of the system of the present invention.

FIG. 1 is a schematic view illustrating the overall operation of the system of the present invention. In FIG. 1, a multiple-displacement engine is provided with a cylinder number control means and a cylinder reduction determination means in order to switch the operating state of the engine from the full-displacement operation to the part displacement operation or from the latter to the former according to the operating condition of the engine. A period calculating means receives signals generated from a crank angle detecting means every predetermined crank angle and calculates the time interval corresponding to the predetermined crank angle. An engine speed calculating means calculates the engine rpm on the basis of the calculated time interval or period. A crank angle determination means which receives the output from the cylinder-reduction determination means and sets the predetermined crank angle to be submitted to the period calculating means to include a crank angle corresponding to the power stroke of a working cylinder in the part-displacement state of the engine.

Figure 2:
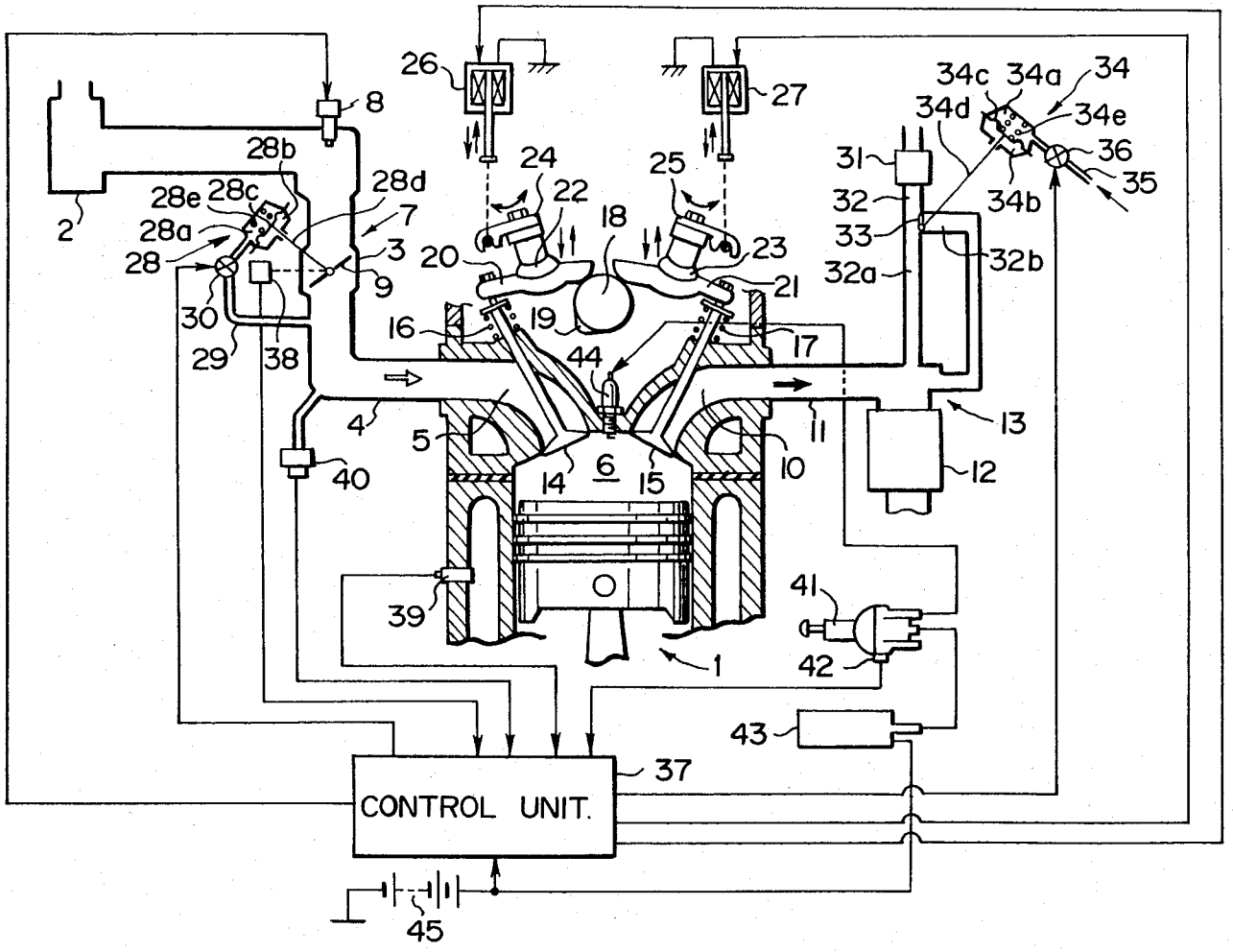
FIG. 2 is a schematic view illustrating a multiple-displacement engine employing an engine speed detecting system in accordance with an embodiment of the present invention.

Now a concrete embodiment of the present invention will be described referring to FIG. 2. Reference numeral 1 denotes an engine body. Intake air is supplied to a combustion chamber 6 via an air cleaner 2, a throttle chamber 3, an intake manifold 4, and an intake port 5. That is, the passage from the air cleaner 2 to the intake port 5 forms an intake passage 7. With the intake air flowing through the intake passage 7 is mixed fuel injected from a fuel injection valve 8. The amount of the intake air is controlled by a throttle valve 9. Exhaust gas from the combustion chamber 6 is discharged to the atmosphere via an exhaust port 10 and an exhaust manifold 11 and after being cleaned by a catalytic converter 12, the passage downstream of the exhaust port 10 forming an exhaust passage 13.

Intake and exhaust valves 14 and 15 respectively for open and close the intake port 6 and the exhaust port 10 are driven by valve trains comprising valve springs 16 and 17 for urging the intake and exhaust valves 14 and 15 in the respective closing directions, a camshaft 18 driven by a crankshaft (not shown), a cam 19 provided on the camshaft 18, a pair of rocker arms 20 and 21, and a pair of tappets 22 and 23 on which the respective rocker arms 20 and 21 pivot. In this particular embodiment, the engine body 1 is a four-cylinder engine, the firing order being 1-3-4-2. In the part-displacement state of the engine, fuel supply to the first and fourth cylinders is cut, and accordingly the tappets 22 and 23 are provided with valve drive control devices 24 and 25, respectively.

The valve drive control devices 24 and 25 respectively comprise solenoids 26 and 27. When the solenoides 26 and 27 are de-energized, the pivotal centers of the rocker arms 20 and 21 on the tappets 22 and 23 are displaced downwardly and the rocker arms 20 and 21 are swung to open and close the intake valve and the exhaust valve in response to rotation of the camshaft 18. Thus when the solenoids 26 and 27 are de-energized, the intake and exhaust valves 14 and 15 for all the cylinders are opened and closed, that is, the engine operates in the full-displacement state. On the other hand, when the solenoids 26 and 27 are energized, the pivotal center of the rocker arms 20 and 21 are adapted to be displaced upwardly to break the interlocking relation between the camshaft 18 and the intake and exhaust valves 14 and 15. Thus, the intake and exhaust valves 14 and 15 for the first and fourth cylinders are kept closed independent of the position of the camshaft 18, that is, the engine operates in the part-displacement state.

The valve drive control devices 24 and 25 are well known (See Japanese Unexamined Patent Publication No. 52(1977)-56212, for example.) and therefore will not be described in more detail, here.

Said throttle valve 9 is provided with a vacuum-operated type actuator 28 for maintaining a constant idling speed. A diaphragm 28*c* defining a vacuum chamber 28*a* and a atmospheric chamber 28*b* is connected to the throttle valve 9 by way of a rod 28*d*. Normally the throttle valve 9 is urged in its closing direction under the force of a return spring 28*e*. The vacuum chamber 28*a* is communicated with the intake passage 7 downstream of the throttle valve 9 by way of a signal conduit 29. The signal conduit 29 is provided with a solenoid valve 30 the opening degree of which is controlled to control the opening degree of the throttle valve 9 so that the idling speed of the engine is held constant as will be described later.

To the exhaust passage 13 is connected a secondary air supply passage 32 provided with a reed valve 31. The secondary air supply passage 32 is bifurcated, immediately downstream of the reed valve 31, into first and second branch conduits 32*a* and 32*b*. Both the branch conduits 32*a* and 32*b* are connected to the exhaust passage 13 upstream of the catalytic converter 12. The first and second branch conduits 32*a* and 32*b* differ from each other in length and the first branch conduit 32*a* which is shorter is for the full-displacement operation of the engine, the other being for the part-displacement operation.

In order to selectively connecting the first and second branch conduits 32*a* and 32*b* to the exhaust passage 13, a switching valve 33 is provided at the bifurcated portion. The switching valve 33 is controlled by a vacuum-operated type actuator 34. That is, a diaphragm 34*c* defining a vacuum chamber 34*a* and an atmospheric chamber 34*b* is connected to the switching valve 33 by way of a rod 34*d*. Normally, the switching valve 33 is urged toward a full-displacement operation position, under the force of a return spring 34*e*, in which the first branch conduit 32*a* for the full-displacement operation communicates the reed valve 31 with the exhaust passage 13. The vacuum chamber 34*a* is connected to the intake passage 7 downstream of the throttle valve 9 by way of a signal conduit 35 which is provided with a solenoid valve 36. As will be described later, the solenoid valve 36 is energized to open the signal conduit 36 during the part-displacement operation of the engine.

A control unit 37 comprising a microcomputer controls the solenoids 26 and 27, and the solenoid valves 30 and 36 to selectively perform the full-displacement operation or the part-displacement operation according to the operating condition of the engine. Though the control unit 37 may control the amount of fuel to be injected, the ignition timing and the like, the part of the operation of the control unit which is not directly related to the present invention will not be described here.

Into the control unit 37 are inputted a throttle-opening-signal from a throttle sensor 38 representing the opening degree of the throttle valve 9, a water temperature signal from a coolant temperature sensor 39 representing engine temperature, an intake vacuum signal from an intake vacuum sensor 40 provided in the intake passage 7, and a crank angle signal generated every predetermined crank angle from a crank angle sensor 42 provided on the distributor 41. The control unit 37 outputs signals to the solenoids 26 and 27, and the solenoid valves 30 and 36. The crank angle sensor 42 outputs a signal every TDC (top dead center) of each cylinder (or every 90 degrees in this particular embodiment), for instance. The crank sensor itself is well known and therefore will not be described in more detail here. In FIG. 2, reference numerals 43, 44 and 45 respectively denote an ignition coil, a spark plug and a battery.

Now the operation of the control unit 37 will be described with reference to the flow charts shown in FIGS. 3 to 5. The flow charts are broadly divided into a cylinder-reduction determination routine (including control of the solenoid valve 36), an engine speed detection routine and an idling speed control routine.

Figure 3:
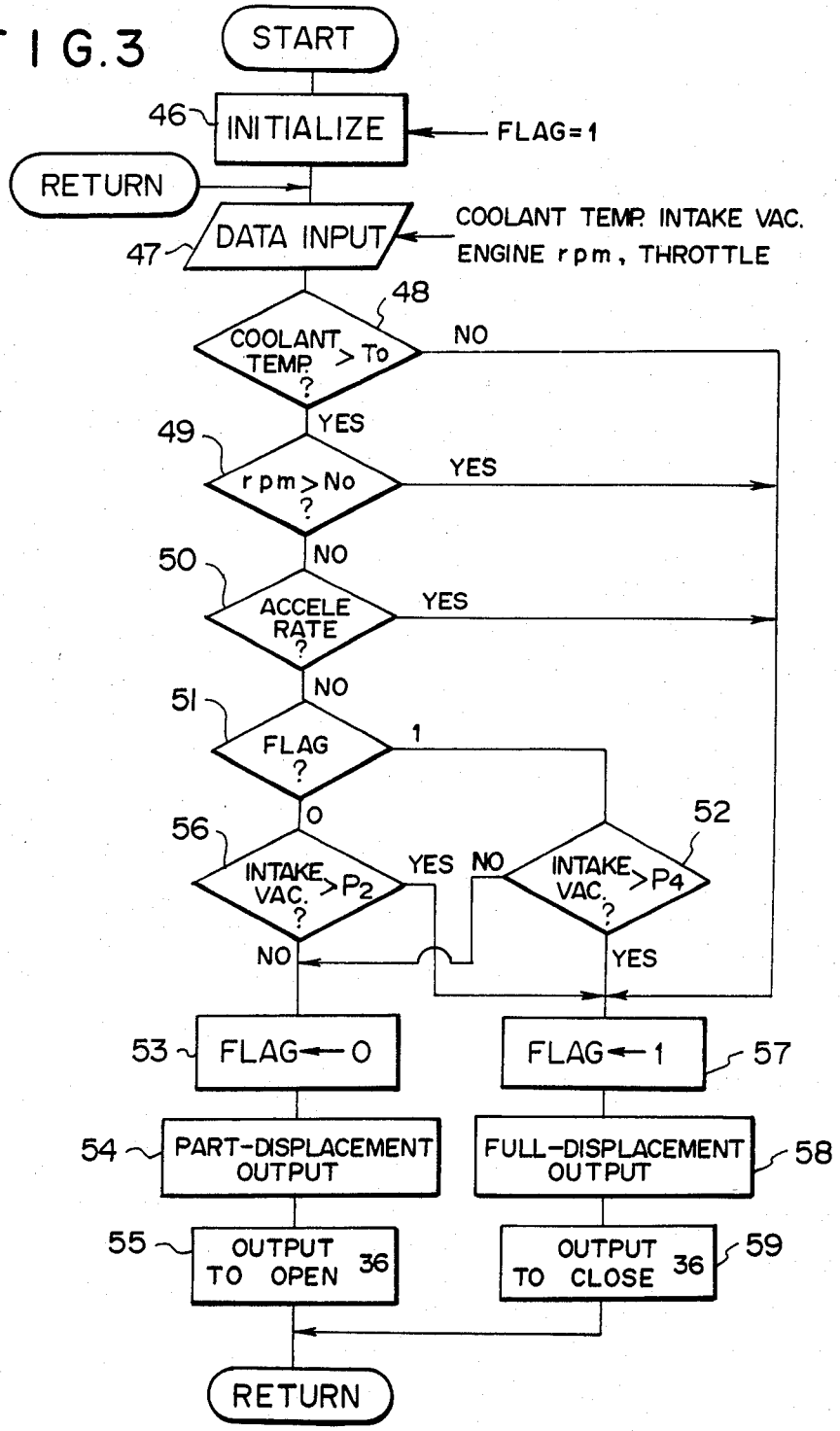
FIG. 3 is a flow chart of the operation of the CPU which is performed to control the engine of FIG. 2.

Cylinder-Reduction Determination Routine (FIG. 3)

In step 46, the flow is first initialized and a cylinder number flag is set to be "1". The cylinder number flag represents the full-displacement operation when it is "1", and the part-displacement operation when it is "0".

In step 47, data of the engine coolant temperature, the intake vacuum, the engine speed, and the throttle opening degree are inputted.

Based on the data inputted in the step 47, whether or not the operating condition of the engine satisfies the conditions to change the operating state of the engine to the part-displacement operation is successively determined in steps 48 to 50. When the engine coolant temperature is not lower than a preset value T0, e.g., 60° C. (step 48), the engine speed is not higher than a preset value N0, e.g., 2,000 rpm (step 49), and at the same time, the vehicle is not accelerated but decelerated or cruising at a steady-speed (step 50), the flow proceeds to step 51. Whether or not the vehicle is accelerated is determined by calculating the amount of change in the throttle opening degree per unit time to obtain acceleration and by comparing the acceleration with a preset acceleration.

Since the cylinder number flag is initialized to be "1", the flow proceeds to step 52, and whether or not the intake vacuum is not lower than a preset value P4 is determined in the step 52. When the intake vacuum is lower than the preset value P4, which represents that load on the engine is relatively light, the flow proceeds to step 53. In step 53, the cylinder number flag is set to be "0". That the flow has proceeded to the step 53 means that all the conditions to change the operating state of the engine to the part-displacement operation are satisfied. Accordingly, there is generated an output representing that the operating state of the engine is to be switched the part-displacement operation (two-cylinder operation in this particular embodiment), or the first and fourth cylinders are to be cut out, in step 54. That is, the solenoids 26 and 27 are energized so that the intake and exhaust valves 14 and 15 of the first and fourth cylinders are kept closed.

At the same time, an output which energizes the solenoid valve 36 to open it is generated in step 55. This introduces the intake vacuum into the vacuum chamber 34*a* of the actuator 34, whereby the switching valve 33 is switched so that the reed valve 31 and the exhaust passage 13 are communicated with each other by way of the second branch conduit 32*b* which is longer than the first branch conduit 32*a*. Secondary air is introduced into the exhaust passage 13 through the second or longer branch conduit 32*b* by exhaust pulsation in the exhaust passage 13. By drawing secondary air through the longer branch conduit 32*b* during the part-displacement operation in which the cycle of the exhaust pulsation is long, the drawing efficiency can be improved.

The flow then returns to the step 47. When the operating condition of the engine does not change, the flow proceeds to the step 51 in the manner described above. Since the cylinder number flag has been set to be "0", the flow proceeds from the step 51 to step 56. In the step 56, it is determined whether or not the intake vacuum is higher than a preset value P2. Since the intake vacuum for a given engine speed during the full-displacement operation differs from that during the part-displacement operation, different values are used for switching the operating state from the full-displacement operation to the part-displacement operation and for switching the operating state from the latter to the former, that is, from P2 to P4, thereby preventing the operating state from being switched back and forth too frequently in a short time, i.e., preventing hunting.

When the engine coolant temperature is lower than the preset value T0, the engine speed is higher than the preset value N0, the vehicle is to be accelerated, or the intake vacuum is higher than the preset value P2 (in the case of the part-displacement operation) or P4 (in the case of the full-displacement operation), the flow is shifted to step 57. In the step 57, the cylinder number flag is set to be "1". And then in step 58, an output representing that the engine is to be operated in the full-displacement state is generated, whereby the solenoids 26 and 27 are de-energized so that the intake and exhaust valves 14 and 15 of all the cylinders are opened and closed.

When the engine is switched to operate in the full-displacement state, an output is delivered to the solenoid valve 36 to de-energize it in step 59, whereby the solenoid valve 36 is opened and the transmission of the intake vacuum to the vacuum chamber 34*a* of the actuator 34 is interrupted. This switches the switching valve 33 so that the reed valve 31 and the exhaust passage 13 are communicated with each other by way of the first or shorter branch conduit 32*a*. By drawing secondary air through the shorter conduit 32*a* during the full-displacement operation in which the cycle of the exhaust pulsation is short, the drawing efficiency can be improved.

Figure 4:
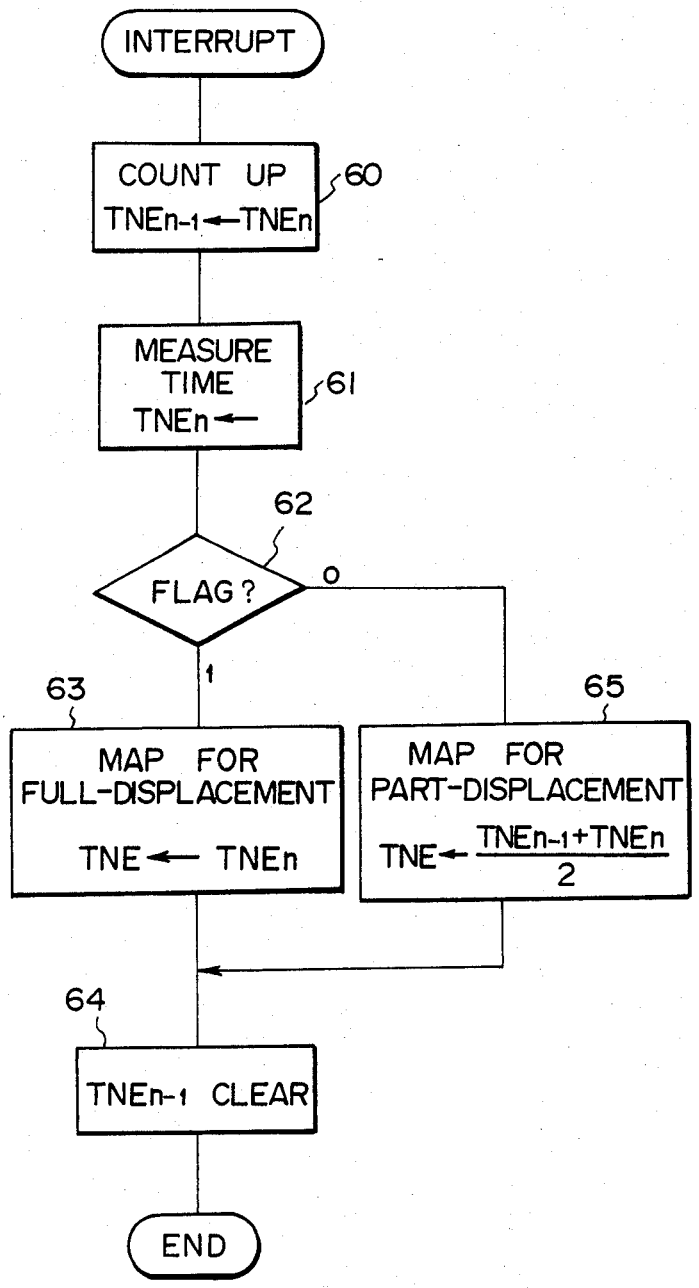
FIG. 4 is a flow chart showing an example of the operation to be performed by the CPU to detect the engine speed in accordance with the present invention.
Figure 5:
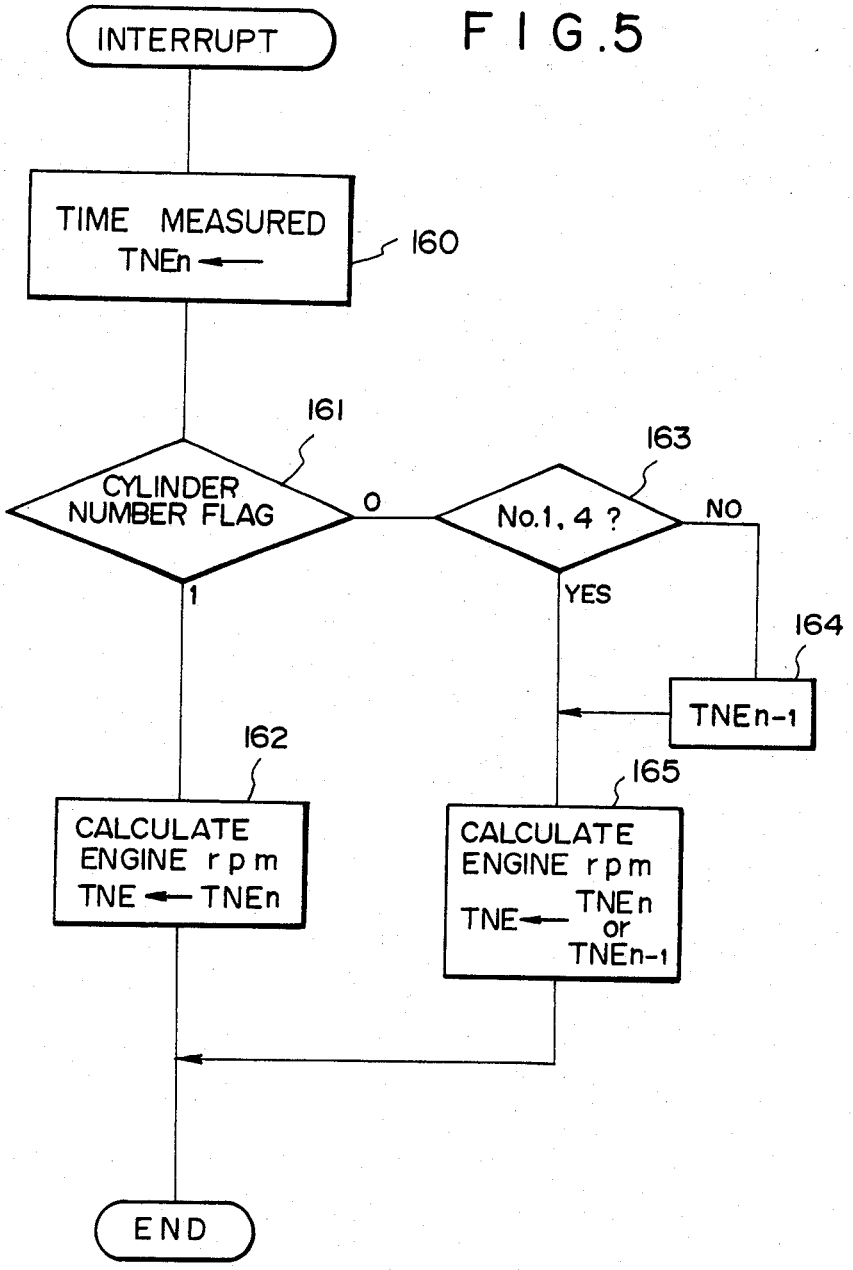
FIG. 5 is a flow chart showing another example of the operation to be performed by the CPU to detect the engine speed in accordance with the present invention.

Engine Speed Detecting Routine (FIGS. 4 and 5)

The flow shown in FIG. 4 is performed interrupting the flow shown in FIG. 3 at each ignition timing, for instance. In step 60, the previously measured time between ignition timings TNEn is shifted to TNEn−1. Then in step 61, a time between ignition timings TNEn is measured. In this embodiment, even the spark plugs for the inoperative cylinders are ignited.

In step 62, whether the cylinder number flag is "1" or "0" is determined. When the cylinder number flag is "1" representing that the engine is to be operated in the full-displacement state, the flow proceeds to step 63. In the step 63, the engine speed TNE is calculated according to a map for the full-displacement operation on the basis of the time between ignition timings TNEn measured in the step 61. Then the previously measured time between ignition timings TNEn−1 is cleared and the flow returns to the step 60.

On the other hand, when it is determined that the cylinder number flag is "0" representing that the engine is to be operated in the part-displacement state in the step 62, the flow proceeds to step 65. In the step 65, the time between ignition timings measured this time TNEn is added to the time between ignition timings measured the last time TNEn−1, and the sum of them are divided by 2 to obtain a so-called moving average. The engine TNE is calculated according to a map for the part-displacement operation on the basis of the moving average. Subsequently, the flow returns to the step 60 via the step 64.

Figure 7:
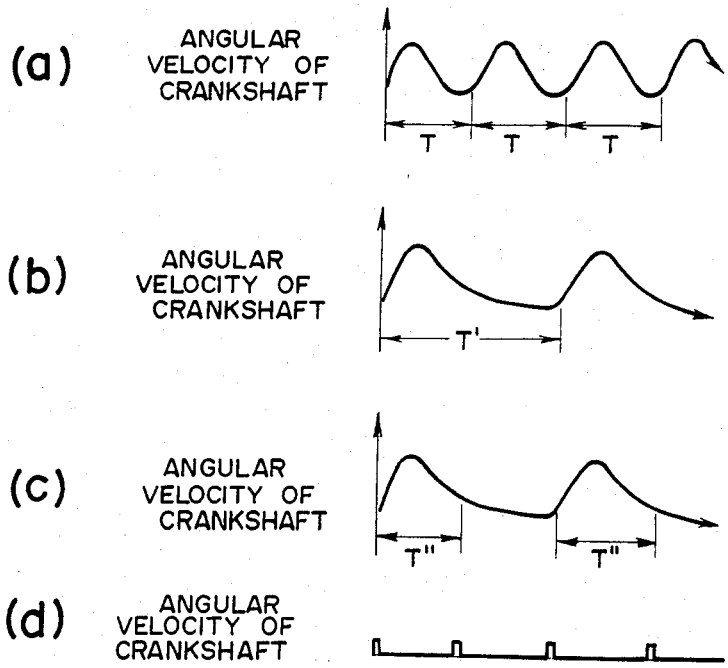

Said measured time between ignition timings TNEn used in the calculation of the engine speed TNE in the full-displacement operation in the step 63 corresponds to period T in FIG. 7-(*a*), and the moving average used in the calculation of the engine speed TNE in the part-displacement operation in the step 65 corresponds to period T′ shown in FIG. 7-(*b*) divided by 2 (T′/2), the period T′ corresponding to the double of one period between the reference crank angle signals shown in FIG. 7-(*d*). That is, the predetermined crank angle the time corresponding to which is used in calculation of both the engine speed in the part-displacement operation and the engine speed in the full-displacement operation includes a crank angle corresponding to the power stroke of a working or operative cylinder as can be seen from FIGS. 7-(*a*) and 7-(*b*). The aforesaid engine speed in conjunction with the step 49 in the flow shown in FIG. 3 is, of course, that calculated in the step 63 or 65.

Though in the above embodiment, the predetermined crank angle includes a crank angle corresponding to the power stroke of an inoperative cylinder (though there is no power stroke of the inoperative cylinders, in fact), the predetermined crank angle may be selected to include only a crank angle corresponding to the power stroke of a working cylinder, i.e., the second or third cylinder in this particular embodiment. In this case, the time to be used in calculation of the engine speed in the part-displacement operation will correspond to period T″ shown in FIG. 7-(*c*), and the flow shown in FIG. 5, for instance, is used instead of the same shown in FIG. 4.

In step 160, a time between ignition timings TNEn is measured. In step 161, whether the cylinder number flag is "1" or "0" is determined. When the cylinder number flag is "1" representing that the engine is operated in the full-displacement state, the flow proceeds to step 162. In the step 162, the engine speed TNE is calculated according to a map for the full-displacement operation on the basis of the time between ignition timings TNEn measured in the step 160, and then the flow returns to the step 160.

On the other hand, when it is determined that the cylinder number flag is "0" representing that the engine is operated in the part-displacement state in the step 161, the flow proceeds to step 163. In the step 163, whether or not the time measured in the step 160 is either the time between the ignition timing for the first cylinder and the third cylinder or the time between the ignition timing for the fourth cylinder and the second cylinder is determined. If no, the flow proceeds to step 165 via step 164 and the engine speed TNE is calculated according to the map for the part-displacement operation on the basis of the previously measured time TNEn−1 rather on the basis of the time measured this time TNEn. If yes, the flow directly proceeds to the step 165 and the engine speed TNE is calculated according to the map for the part-displacement operation on the basis of the time measured this time TNEn in the step 160. After the step 165, the flow returns to the step 160.

Figure 6:
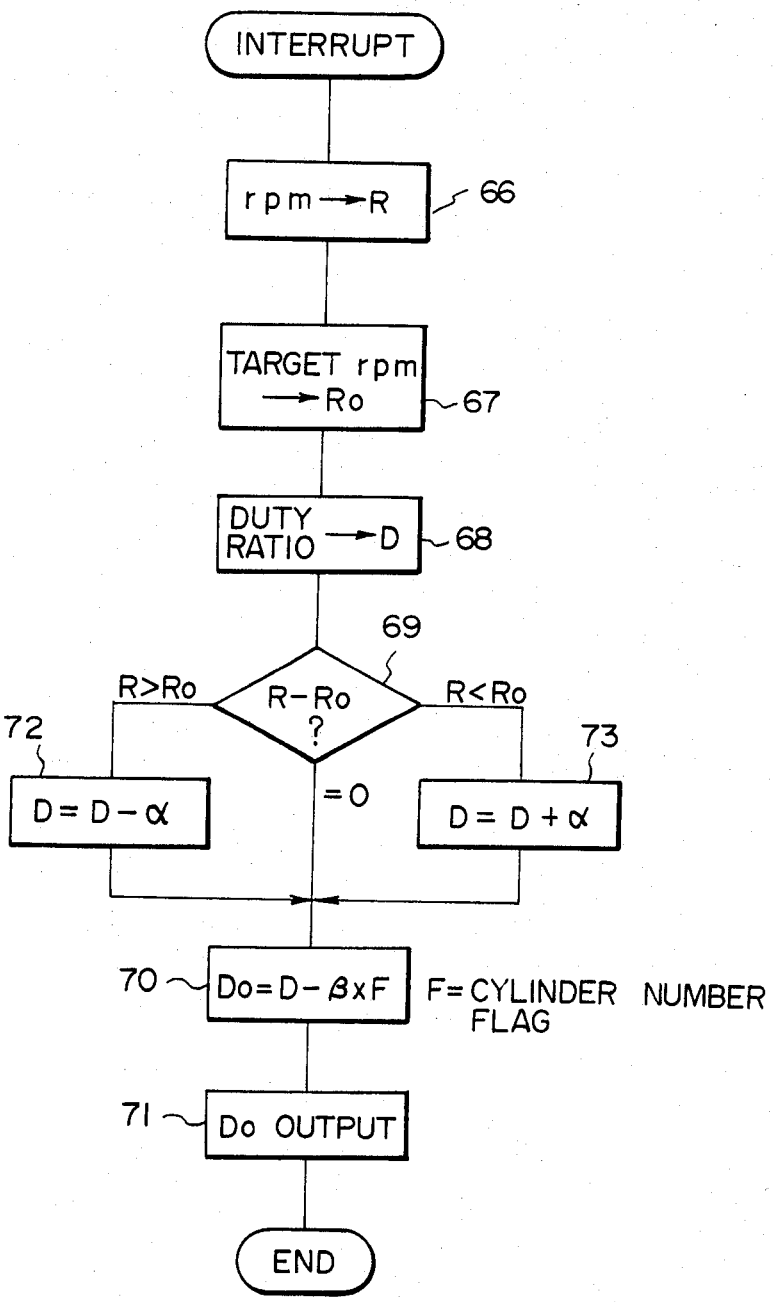
FIG. 6 is a flow chart showing the operation to be performed by the CPU to control the idling speed of the engine, and FIGS. 7-(*a*) to 7-(*d*) are views for illustrating the principle of the present invention.

Idling Speed Control Routine (FIG. 6)

The flow shown in FIG. 6 is performed interrupting the flow shown in FIG. 4 at a predetermined timing only when the engine is idling. It is determined that the engine idling, for instance, when the throttle valve 9 is fully closed and the engine speed is lower than a predetermined value.

In step 66, the actual engine speed R is read, and then a target idling speed R0 is read in step 67. In step 68, reference duty ratio D of a pulse to be delivered to the solenoid valve 30 (This reference duty ratio is set for the part-displacement operation.) is read in.

In step 69, the actual engine speed R is compared with the target idling speed R0. When the former is equal to the latter, the flow proceeds to step 70. In the step 70, said reference duty ratio D is corrected according to whether the engine is operating in the full-displacement state or in the part-displacement state to calculate a final duty ratio D0. That is, when the engine is operating in the full-displacement state (the cylinder number flag F is "1"), correction coefficient for the full-displacement operation $\beta$ is subtracted from the reference duty ratio D, while when the engine is operating in the part-displacement state (the cylinder number flag F is "0", i.e., $\beta \times F = 0$), the reference duty ratio D is outputted without correction since the duty ratio D is set for the part-displacement operation in step 68.

When it is determined that the actual engine speed R is higher than the target idling speed R0 in the step 69, the flow proceeds to step 72. In the step 72, correction value $\alpha$ is subtracted from the reference duty ratio D to reduce the duty ratio. The reduced duty ratio is further corrected in the step 70 according to whether the engine is operating in the full-displacement state or in the part-displacement state, in the manner described above. On the other hand, when the actual engine speed R is lower than the target idling speed R0, a correction value $\alpha$ is added to the reference duty ratio D in step 73, and the corrected duty ratio is further corrected in the step 70 according to the operating state of the engine in the manner described above. After the step 70, the flow proceeds to step 71 and a pulse having the final duty ratio D0 is outputted to the solenoid valve 30, whereby introduction of the intake vacuum to the vacuum chamber 28*a* of the actuator 28 or the opening degree of the throttle valve 9 is controlled according to the duty ratio D0 to converge the actual engine speed to the target idling speed R0. As described above, the intake vacuum significantly differs depending on the operating state of the engine. Therefore, in order to compensate for the difference, the duty ratio is changed according to the operating state of the engine in the step 70.

The present invention need not be limited to the embodiments described but various modifications can be made.

For example, the present invention can be applied to any multiple-displacement engine without limiting to four-cylindered multiple-displacement engine. Further the number of cylinders to be cut out need not be limited to half the cylinder. For example, two or four cylinders of a six-cylindered engine may be cut out.

In order to cut out or make inoperative a cylinder, though the interlocking relation between the camshaft and the intake and exhaust valves are broken by virtue of the valve drive control devices 24 and 25 in the above embodiment, a shutter valve may be provided in the intake passage corresponding to the cylinder to be cut out to cut supply of air-fuel mixture thereto. In the case of engines wherein a fuel supplying device such as a fuel injection valve is provided for each cylinder, fuel supply from the fuel supplying device for the cylinder to be cut out may be interrupted to make the cylinder inoperative. In this case, intake air may be or may not be supplied to the cylinder to be cut out. However, it is preferred that intake air to the cylinder to be cut out be also cut to reduce so-called pumping loss, thereby further improving fuel consumption ratio.

Said control unit may comprise either an analogue computer or a digital computer.

We claim:

1. An engine speed detecting system for a multiple-displacement engine which can be selectively operated in a full-displacement state or in a part-displacement state according to the operating condition of the engine, all the cylinders being fed with fuel in the full-displacement state and fuel supply to a part of the cylinders being cut to make inoperative the cylinder or the cylinders in the part-displacement state, said engine speed detecting system comprising, a cylinder-reduction determination means for determining whether the engine is to be operated in the full-displacement state or in the part-displacement state, a cylinder number control means for controlling the operating state of the engine according to an output of the cylinder-reduction determination means, a crank angle detecting means for generating a signal every predetermined crank angle, a period calculating means which receives the signals from the crank angle detecting means and calculates the time interval corresponding to the predetermined crank angle, a crank angle determination means which receives an output of the cylinder-reduction determination means and sets said predetermined crank angle used for calculation of said time interval in the part-displacement state to include a crank angle corresponding to the power stroke of the operative cylinder in the part-displacement state, and an engine speed calculating means for calculating the engine speed on the basis of the time interval calculated by the period calculating means.

2. An engine speed detecting system as defined in claim 1 in which said crank angle determination means sets the sum of a crank angle corresponding to the power stroke of the operative cylinder and the same corresponding to the power stroke of the inoperative cylinder as said predetermined crank angle used for calculation of said time interval in the part-displacement state.

3. An engine speed detecting system as defined in claim 1 in which said crank angle determination means sets a crank angle corresponding to the power stroke of the operative cylinder as said predetermined crank angle used for calculation of said time interval in the part-displacement state.

4. An engine speed detecting system as defined in claim 1 in which said crank angle detecting means detects ignition signals of the engine and generates said signal each time the ignition signal is detected, said period calculating means measuring the time interval between the ignition signals as said time interval corresponding to the predetermined crank angle.

5. An engine speed detecting system as defined in claim 1 in which said cylinder-reduction determination means determines that the engine is to be operated in the part-displacement state when load on the engine is less than a predetermined value.

6. An engine speed detecting system as defined in claim 1 in which the cylinders the power strokes of which do not adjoin each other are adapted to be made inoperative.

7. An engine speed detecting system for a multiple-displacement engine which can be selectively operated in a full-displacement state or in a part-displacement state according to the operating condition of the engine, fuel being supplied to all the cylinders in the full-displacement state, and fuel supply to a part of the cylinders being cut to make inoperative the cylinder or the cylinders in the part-displacement state, said engine speed detecting system comprising, a cylinder-reduction determination means which detects load on the engine and generates a signal for cutting fuel supply to a part of the cylinders when the load on the engine is less than a predetermined value, a cylinder number control means which receives the signal from the cylinder reduction determination means and is adapted to cut fuel supply to said part of the cylinders, a crank angle detecting means which generates a signal every predetermined crank angle corresponding to a crank angle between ignition timings, a period calculating means which receives the signal from the crank angle detecting means and calculates the time interval between the ignition timings, a crank angle determination means which receives an output of the cylinder-reduction determination means and sets, in the part-displacement state, said time interval between the ignition timings to be the time interval between the ignition timings for the operative cylinders, and an engine speed calculating means for calculating the engine speed on the basis of the time interval calculated by the period calculating means.

* * * * *